US012760385B2

(12) United States Patent
Wu et al.

(10) Patent No.: US 12,760,385 B2
(45) Date of Patent: Oct. 13, 2026

(54) SEAWATER CORROSION-RESISTANT MARINE ENGINEERING STEEL AND PREPARATION METHOD THEREOF

(71) Applicants: WUHAN UNIVERSITY OF SCIENCE AND TECHNOLOGY, Wuhan (CN); WUKE XINCAI (WUHAN) TECHNOLOGY CO., LTD., Wuhan (CN); WUKE COMPOSITE MATERIALS (HAIKOU) TECHNOLOGY CO., LTD., Haikou (CN); SINO-ENERGY HUAYUAN FLOATING WIND INSTITUTE, Qingdao (CN)

(72) Inventors: Kaiming Wu, Wuhan (CN); Zhihui Wang, Wuhan (CN); Shaoguan Xiang, Wuhan (CN)

(73) Assignees: WUHAN UNIVERSITY OF SCIENCE AND TECHNOLOGY, Wuhan (CN); WUKE XINCAI (WUHAN) TECHNOLOGY CO., LTD., Wuhan (CN); WUKE COMPOSITE MATERIALS (HAIKOU) TECHNOLOGY CO., LTD., Haikou (CN); SINO-ENERGY HUAYUAN FLOATING WIND INSTITUTE, Qingdao (CN)

( * ) Notice: Subject to any disclaimer, the term of this patent is extended or adjusted under 35 U.S.C. 154(b) by 386 days.

(21) Appl. No.: 18/434,860

(22) Filed: Feb. 7, 2024

(65) Prior Publication Data

US 2025/0043374 A1 Feb. 6, 2025

(30) Foreign Application Priority Data

Aug. 3, 2023 (CN) ..... 202310971957.X

(51) Int. Cl.

| | |
|---|---|
| ***C21D 9/00*** | (2006.01) |
| ***C21C 5/52*** | (2006.01) |
| ***C21C 7/06*** | (2006.01) |
| ***C21C 7/10*** | (2006.01) |
| ***C21D 1/18*** | (2006.01) |
| ***C21D 6/00*** | (2006.01) |
| ***C21D 8/02*** | (2026.01) |
| ***C21D 8/021*** | (2026.01) |
| ***C21D 8/0221*** | (2026.01) |
| ***C21D 8/0247*** | (2026.01) |
| ***C22C 33/04*** | (2006.01) |
| ***C22C 38/00*** | (2006.01) |
| ***C22C 38/02*** | (2006.01) |
| ***C22C 38/26*** | (2006.01) |
| ***C22C 38/28*** | (2006.01) |

(52) U.S. Cl.

CPC ..... *C21D 9/0081* (2013.01); *C21C 5/5264* (2013.01); *C21C 7/06* (2013.01); *C21C 7/10* (2013.01); *C21D 1/18* (2013.01); *C21D 6/002* (2013.01); *C21D 6/008* (2013.01); *C21D 8/02* (2013.01); *C21D 8/021* (2013.01); *C21D 8/0226* (2013.01); *C21D 8/0247* (2013.01); *C22C 33/04* (2013.01); *C22C 38/002* (2013.01); *C22C 38/005* (2013.01); *C22C 38/02* (2013.01); *C22C 38/26* (2013.01); *C22C 38/28* (2013.01); *C21D 2211/005* (2013.01)

(58) Field of Classification Search

None

See application file for complete search history.

(56) References Cited

FOREIGN PATENT DOCUMENTS

JP 2003253331 A * 9/2003

* cited by examiner

*Primary Examiner* — Anthony M Liang

(74) *Attorney, Agent, or Firm* — Bayramoglu Law Offices LLC

(57) ABSTRACT

A seawater corrosion-resistant marine engineering steel and a preparation method thereof are provided. The seawater corrosion-resistant marine engineering steel consists of the following chemical compositions in percentage by mass: C: 0.011-0.069%, Si: 0.11-0.29%, Cr: 1.51-1.99%, Nb: 0.02-0.05%, Zr: 0.01-0.02%, RE: 0.0034-0.02%, and the balance of Fe and inevitable impurities. The mass percentages of Zr element and RE element also satisfy the following formulas: 0.01%<Zr+RE<0.02%, and Zr/RE=1-3. The marine engineering steel is designed with cheap chemical compositions of low carbon, low silicon and medium chromium, and is completely free of valuable corrosion-resistant metal elements such as Ni and Cu. Instead of the traditional Al deoxidization technology, Si deoxidization assisted by Zr-RE composite deoxidization is used to form a fine, dispersed and uniform composite oxysulfide.

17 Claims, 9 Drawing Sheets

SEAWATER CORROSION-RESISTANT MARINE ENGINEERING STEEL AND PREPARATION METHOD THEREOF

CROSS-REFERENCE TO THE RELATED APPLICATIONS

This application is based upon and claims priority to Chinese Patent Application No. 202310971957.X, filed on Aug. 3, 2023, the entire contents of which are incorporated herein by reference.

TECHNICAL FIELD

The present invention relates to the field of metal material technologies, in particular to a seawater corrosion-resistant marine engineering steel and a preparation method thereof.

BACKGROUND

The total area of the ocean is about 70% of the total area of the earth, and there are numerous types of resources in the ocean. How to develop and utilize the marine resources reasonably and efficiently has become a hot topic today. Research and development of seawater corrosion-resistant steels is an important basis for sustainable development of marine resources. The salt content in the ocean accounts for about 3.5%, and $Cl^-$ has strong corrosion, which causes not only waste of the steel materials, but also unpredictable losses to marine structures and devices. Therefore, how to improve a corrosion resistance of the steel materials has become one of the key technologies of marine engineering steels.

The seawater corrosion-resistant steels are a type of low-alloy high-strength steel developed for devices for tidal current power generation, seawater power generation, seawater temperature difference power generation, offshore wind power generation, ocean waves power generation and other power generation devices, and for the fields such as coastal cross-sea bridges, submarine containers related to ocean development, various large-scale ocean compositions for resource development, shipbuilding steel and polar ice breaking.

The research on the seawater corrosion-resistant steels abroad began in 1930s. Since 1930, the United States and Japan, as representatives, have begun to research and develop new types of applied seawater corrosion-resistant steel materials. By 1946, the United States had developed a new type of the steel plate pile steel for the applied steel materials in a marine splash zone, made in-depth research on Ni—Cu—P series low-alloy high-strength steels, and made a breakthrough and developed a new type of Mariner steel with high seawater corrosion resistance until 1951. The United States firstly started the research on the seawater corrosion-resistant steels, and in 1951, the Ni—Cu—P series Mariner steel was born. This steel contains 0.5% of Ni, 0.5% of Cu and 0.1% of P, and its seawater corrosion resistance in the splash zone is good and 2-3 times that of ordinary carbon steel. However, the P content in such type of the steel is high (0.08-0.15%), and the steel plate with a thickness greater than 20 mm is not suitable for welding and cannot be used for welding marine structural steels.

Based on this, various countries in the world have developed various series of seawater corrosion-resistant steels according to their own conditions. For example, in Japan. Mariloy (Cu—Cr—P, Cu—Cr—Al—P, Cu—Cr—Mo) series seawater corrosion-resistant low-alloy high-strength steels with the P content≤0.03% were developed specific to the high P content and poor weldability of the "Mariner" steel. Main reasons why the Mariloy series steels have such a good corrosion resistance are as follows: (1) the coexistence of chromium and silicon promotes the formation of a stable chromium-silicon passivation film in the corrosion process, and can also prevent the growth of bacteria in polluted seawater, thereby slowing down corrosion of the steels; (2) since silicon, chromium and copper are enriched in a rust layer and directly act on a metal surface, the corrosion products close to a substrate become fine and dense, which hinders the diffusion of dissolved oxygen in seawater to steel surfaces and slows down a corrosion rate of the steels. Japan has made a study on how to improve the weldability of the seawater corrosion-resistant steels and save the cost simultaneously and found that the replacement of alloying element Ni with Cr can greatly reduce the production cost; and the addition of other alloying elements in steel, such as aluminum, cobalt, niobium and titanium, is beneficial to improve the corrosion resistance. At present, the low-alloy seawater corrosion-resistant steels produced abroad can be divided into a Ni—Cu—P series, a Cr—Nb series, a Cr—Cu series, a Cr—Al series, a Cr—Cu—Si series, a Cr—Cu—Al series, a Cr—Cu—Mo series, a Cr—Cu—P series and a Cr—Al—Mo series according to the composition series.

There are nearly 200 types of seawater corrosion-resistant steel test grades developed in China, among which 10Cr2MoAlRE, 08PVRE, 09MnCuPTi, 10MnPNbRE, 10NiCuAs and 10CrMoAl have passed the appraisal. In addition to the above low-alloy high-strength steels, there are also several types of following seawater corrosion-resistant stainless steels: (1) an austenitic stainless steel, which has better corrosion resistance, but a yield strength thereof is insufficient, the average yield strength is ≤300 MPa, and the yield strength in special cases is 450 MPa-700 MPa; (2) a ferritic stainless steel, a yield strength thereof is <300 MPa; (3) a duplex stainless steel, which is different from the above two steels and has a higher yield strength, which can reach 700 MPa; and (4) a precipitation hardening stainless steel, which has the advantage of very high strength, but has an obvious disadvantage that the seawater corrosion resistance is insufficient. In view of this, the present invention provides a seawater corrosion-resistant marine engineering steel and a preparation method thereof.

SUMMARY

Aiming at the problems that the existing seawater corrosion-resistant low-alloy high-strength steels and stainless steel alloys are insufficient in seawater corrosion resistance, especially in local corrosion resistance, and high in cost, the present invention provides a seawater corrosion-resistant marine engineering steel and a preparation method thereof.

The present invention solves the above technical problems. The first object is to provide a seawater corrosion-resistant marine engineering steel, which consists of the following chemical compositions in percentage by mass: C: 0.011-0.069%, Si: 0.11-0.29%, Cr: 1.51-1.99%, Nb: 0.02-0.05%, Zr: 0.01-0.02%, RE: 0.0034-0.02%, and the balance of Fe and inevitable impurities; and mass percentages of Zr element and RE element also satisfy the following formulas: 0.01%<Zr+RE<0.02% and Zr/RE=1-3.

Various elements in the seawater corrosion-resistant marine engineering steel according to the present invention play the following roles:

C element: C element is one of the most basic elements added to the steel, and its solid solution strengthening and precipitation strengthening can significantly affect mechanical properties of the steel material, but C will significantly reduce a local corrosion resistance of the steel; at the same time. C is not conducive to the weldability of the steel. In general, in the case of needing the steel with excellent weldability, the carbon content must be strictly controlled. Therefore, the C content in the marine engineering steel according to the present invention is 0.011-0.069%.

Si element: Si can inhibit the generation of acids in a rust layer and prevent invasion of $Cl^-$. In an inner rust layer, Si mainly exists in a spinel oxide in the form of a bivalent oxide, and higher Si is beneficial to refine α-FeOOOH in the rust layer, so that the inner rust layer is dense to hinder the invasion of $Cl^-$. At the same time, the solid solution of Si element in ferrite and austenite plays a strengthening role and improves the mechanical properties of the steel. At the same time, the addition of Si element to the steel can improve fluidity of molten steel. However, if Si element in the substrate exceeds a certain range, it will promote the nucleation of grain boundary-like ferrite, inhibit the formation of acicular ferrite, and increase the percentage of M-A compositions in the steel. Excessive Si is not conducive to plasticity and toughness of the steel, and also reduces the weldability of the steel. Considering the above factors comprehensively, the silicon content in the marine engineering steel according to the present invention is 0.11-0.29%.

Mn element: Mn is an important solid solution strengthening element. When the carbon content in the steel is lower, proper addition of alloying element Mn can play a good role in solid solution strengthening, and a Mn solid solution in the ferrite can improve the mechanical properties of the steel. However, Mn element and P element will lead to a banded structure of the steel material, and the addition of Mn element into the steel will enlarge a y phase region and reduce a critical cooling rate of the steel, which is prone to obtain a bainite structure. In addition, the corrosion resistance of the low-alloy high-strength steel is inversely proportional to the Mn content, so that the Mn content in the steel should not be too high. In order to improve the seawater corrosion resistance, manganese is not used for strengthening as much as possible, and Cr element is used instead.

Cr element: with the increase of Cr content in the steel, α-FeOOH can be effectively refined. When the Cr content in α-FeOOH exceeds 5%, the entrance of corrosive anions, such as $Cl^-$, can be prevented, thereby improving the seawater corrosion resistance of the steel material. At the same time, the enrichment of Cr element in the rust layer increases an electrode potential of the substrate. Considering the above factors comprehensively, the chromium element in the marine engineering steel according to the present invention is 1.51-1.99%.

Nb element: Nb is an important refined grain element in the steel. NbC induced and precipitated by strain of Nb in a hot rolling process can hinder the recovery and recrystallization of deformed austenite, and fine and dispersed carbonitride particles are precipitated at low temperature to pin dislocations, which significantly improves the strength and toughness of the steel. Considering the above factors comprehensively, the niobium content in the marine engineering steel according to the present invention is 0.02-0.05%.

Zr element: zirconium is a strong carbide forming element, and also a strong deoxidizing element and a composite oxysulfide forming element. The addition of a small amount of Zr has the effects of degassing, purifying and refining grains, which is conductive to increasing the low-temperature performance of the marine engineering steel and improving the stamping performance. When Zr is dissolved in the austenite, the hardenability of the steel is significantly enhanced. Therefore, the zirconium content of the marine engineering steel according to the present invention is 0.01-0.02%.

Rare earth elements: the main functions of rare earth elements in the steel substrate include the following three aspects: purification of the molten steel, modifying of inclusions and microalloying. The purification of the molten steel: rare earth has extremely strong chemical reactivity, and is thus easily combined with sulfur element and oxygen element in the molten steel to form high-melting point compounds, which are precipitated from the molten steel and purify the molten steel. In addition, the rare earth also has strong deoxidization ability, which is stronger than Mg, Al and Ti elements, equal to Ca element, and also has strong desulfurization ability, second only to Ca element. Modifying of inclusions: the addition of rare earth elements to the steel can change the shape, size and distribution of the inclusions formed in the steel, and at the same time types of the inclusions are changed through reaction between the rare earth elements and the inclusions. In this way, harmful inclusions in the steel are replaced, the mechanical properties of the steel substrate are improved and the seawater corrosion resistance of the steel is effectively improved. The rare earth elements have strong metallicity, and are preferentially combined with sulfur element to eliminate formed MnS inclusions; and the inclusions are enabled to be spheroidized and distributed dispersedly, thereby effectively controlling forming types, forms and distribution of the inclusions. Addition of the rare earth elements to the steel can form fine spherical compounds, which are dispersedly uniformly distributed in the steel substrate and change the distribution state of elongated MnS inclusions along grain boundaries. At the same time, the compound inclusions formed by the rare earth and other elements have a high melting point, and are precipitated before solidification of the molten steel. The formed rare earth compounds have a dislocation matching degree close to that of the crystal of the steel, and are finely evenly distributed in the molten steel as nucleation particles, which reduces the undercooling of solidification and crystallization of the molten steel, refines the structure of the steel and reduces segregation. Microalloying: the addition of the rare earth elements to the steel can play a role in solid solution strengthening. In addition, the combination of the rare earth elements and hydrogen element reduces the sensitivity of hydrogen-induced cracks. Considering the above factors comprehensively, the rare earth content in the marine engineering steel according to the present invention is 0.0034-0.02%.

The present invention has the following beneficial effects:

(1) The marine engineering steel according to the present invention is designed with cheap chemical compositions of low carbon, low silicon and medium chromium, and is completely free of precious corrosion-resistant metal elements such as Ni and Cu, thereby greatly reducing the material cost; instead of the traditional Al deoxidization technology, Si deoxidization assisted by Zr-RE composite deoxidization is used to form a fine, dispersed and uniform composite oxysulfide, which greatly decreases the density of corrosion-active inclusions and significantly improves the seawater corrosion resistance.

(2) The marine engineering steel according to the present invention is especially suitable for a marine environment steel such as a marine engineering steel, a warship and ship steel, an offshore fixed wind power steel, an offshore floating wind power steel, a coastal cross-sea bridge steel, an iron tower steel and a track steel, and can obviously improve the corrosion resistance to seawater mediums rich in chloride ions.

It should be noted that as for the above formula Zr/RE=1-3, Zr and RE respectively represent respective mass percentages, and values substituted into the above formula are the values before percent signs, for example, if the mass percentage of Zr is 0.012% and the mass percentage of RE is 0.006%, then after substitution into the above formula. Zr/RE=0.012/0.006=2.

Based on the above technical solution, the present invention may also be improved as follows.

Further, the seawater corrosion-resistant marine engineering steel consists of the following chemical compositions in percentage by mass: C: 0.029-0.068%, Si: 0.15-0.28%, Cr: 1.55-1.78%, Nb: 0.025-0.049%, Zr: 0.01-0.0117%. RE: 0.0039-0.0099%, and the balance of Fe and inevitable impurities.

Further, the seawater corrosion-resistant marine engineering steel consists of the following chemical compositions in percentage by mass: C: 0.04%, Si: 0.20%, Cr: 1.75%, Nb: 0.035%, Zr: 0.012%, RE: 0.006%, and the balance of Fe and inevitable impurities.

The above further solution adopted has the following beneficial effect: the seawater corrosion resistance of the marine engineering steel with the above chemical compositions in percentage by mass is more excellent.

Further, in the other inevitable impurities, a mass percentage of S element satisfies: S≤0.0010%.

Further, the RE element includes lanthanum and cerium, and a weight ratio of the lanthanum element to the cerium element is (70-90):(10-30).

Further, a microstructure type of the marine engineering steel is acicular ferrite and polygonal grain boundary ferrite, and a quantity ratio of the polygonal grain boundary ferrite to the acicular ferrite is 4-8.

Further, a density of corrosion-active inclusions in the marine engineering steel is less than or equal to 5/mm$^2$.

Further, a saturation current density of the marine engineering steel is less than or equal to 6.0 mA under the condition that a static electrode potential is equal to −300 mV; and a corrosion rate of the marine engineering steel is less than or equal to 0.04/mm·a under the condition that a mass content of NaCl in a seawater solution is 3.5%.

A second object of the present invention is to provide a method for preparing a seawater corrosion-resistant marine engineering steel, including the following steps:

1) smelting and refining molten steel in turn, then carrying out vacuum treatment, and then continuously casting the molten steel into a slab to obtain a casting slab;
2) carrying out conventional heating treatment and soaking treatment on the casting slab to obtain a heat-treated casting slab; and
3) continuously rolling the heat-treated casting slab, controlling a final rolling temperature to 750-850° C., cooling by water to 410-550° C. after rolling, and naturally cooling to a room temperature to obtain the marine engineering steel.

Further, a method for the smelting and refining in step 1) includes following steps: steelmaking molten iron and/or scrap steel by using a converter (BOF) or an electric arc furnace (EAF), and then adjusting a temperature and compositions to obtain the molten steel, wherein a tapping temperature of the molten steel is adjusted to 1,549-1,679° C., and a free oxygen content in the molten steel is 119-389 ppm; bringing the molten steel into a steel ladle and stirring the molten steel for 3-10 min with fine argon bubbling, and then pre-deoxidizing the molten steel in the steel ladle by using Fe—Si alloy or Fe—Si—Mn alloy, so as to adjust the free oxygen content in the molten steel to 19-99 ppm; stirring the molten steel for 4-6 min with fine argon bubbling and then carrying out final deoxidization by a composite additive; and then carrying out ladle furnace (LF) refining, vacuum degassing (VD) refining or Ruhrstahl-Heraeus (RH) refining on the molten steel after the final deoxidization.

The above composite additive is added into the above molten steel in the form of blocky alloy or a cored wire, and a particle size of the composite additive is 5-19 mm; an addition amount of the composite additive is 0.59-3.9 kg per ton of molten steel. The composite additive is a composition of zirconium, lanthanum and cerium, and a weight ratio of zirconium, lanthanum and cerium is 8:1.8:4.2.

BRIEF DESCRIPTION OF THE DRAWINGS

FIGS. 3A-3D show an alternating current (AC) impedance result of a marine engineering steel prepared in Embodiment 1 in a 3.5% NaCl solution according to the present invention; wherein FIG. 3A is a Nyquist diagram, FIGS. 3B and 3C are Bode diagrams, and FIG. 3D is an equivalent circuit diagram;

FIGS. 4A-4D show an AC impedance result of a comparative steel in a 3.5% NaCl solution according to the present invention; wherein FIG. 4A is a Nyquist diagram, FIGS. 4B and 4C are Bode diagrams, and FIG. 4D is an equivalent circuit diagram;

DETAILED DESCRIPTION OF THE EMBODIMENTS

Figure 1:
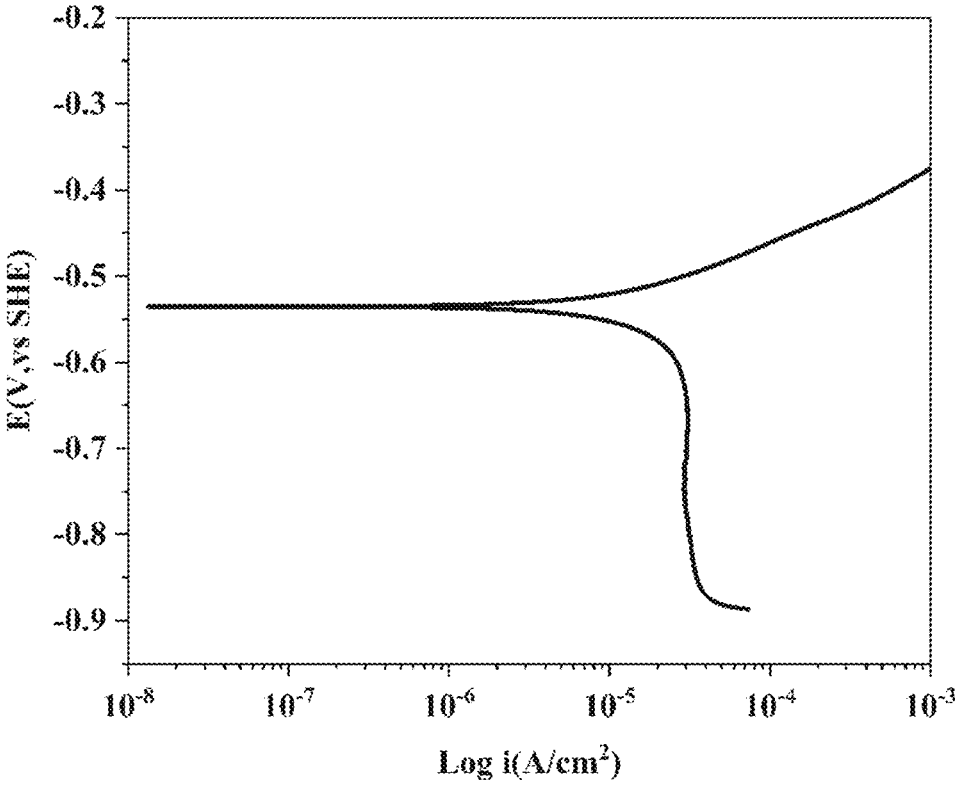
FIG. 1 shows a potentiodynamic polarization result of a marine engineering steel prepared in Embodiment 1 in a 3.5% NaCl solution according to the present invention.

The principles and features of the present invention are described below, and the examples given are only for explaining the present invention, not for limiting the scope of the present invention. Where the specific technologies or conditions are not specified in the embodiments, the technologies or conditions described in the literature in the art or product specifications shall be followed. The reagents or instruments used are all conventional products purchasable through regular channels if manufacturers are not indicated thereon.

The following composite additive is a composition of zirconium, lanthanum and cerium, and a weight ratio of zirconium, lanthanum and cerium is 8:4.4:1.1; and comparative steel Q345 is obtained by performing final deoxidization with conventional aluminum blocks, aluminum particles or aluminum wires to form coarse and clustered alumina, composite oxides thereof and the like.

Embodiment 1

The present embodiment relates to a seawater corrosion-resistant marine engineering steel, which consists of the following chemical compositions in percentage by mass: 0.04% of C, 0.20% of Si, 1.75% of Cr, 0.035% of Nb, 0.012% of Zr, 0.006% of RE, 0.0008% of S, and the balance of Fe and inevitable impurities. The RE includes lanthanum and cerium, and a weight ratio of the lanthanum element to the cerium element is 90:10.

The present embodiment relates to a method for preparing a seawater corrosion-resistant marine engineering steel, which includes the following steps:

1) Molten steel is smelted and refined in turn, then vacuum treating is carried out, and then the molten steel is continuously cast into a slab to obtain a casting slab.

A specific method of the smelting and refining in step 1) is as follows: after performing steelmaking on molten iron by using a converter, the temperature and compositions of the molten steel are adjusted, wherein the tapping temperature is adjusted to 1,615° C., and the free oxygen content in the molten steel is 205 ppm; after entering a steel ladle, the molten steel is stirred for 7 min with fine argon bubbling, and then pre-deoxidized by using Fe—Si alloy or Fe—Si—Mn alloy in the steel ladle, so that the free oxygen content in the molten steel is adjusted to 60 ppm; stirring is performed for 5 min with fine argon bubbling, and then the final deoxidization is performed with the composite additive; the composite additive is added into the molten steel in the form of blocky alloy or a cored wire, and a particle size of the composite additive is 12 mm; an addition amount of the composite additive is 1.9 kg per ton of molten steel; and then LF refining and RH refining are performed on the molten steel according to the conventional process.

LF Refining:

The viscosity of refining slag is controlled to 1.525-1.938 Pa·s, so as to improve the inclusion adsorbing ability of a slag system, thereby increasing the cleanliness of the molten steel; the alkalinity R of white slag in a refining furnace is controlled so that $5.25 \leq R \leq 7.45$, which is conductive to increasing the desulfurization rate, increasing the cleanliness of the molten steel and decreasing oxide inclusions in the molten steel; the MI slag index (=a ratio of $CaO/SiO_2$: $Al_2O_3$) is controlled so that MI>0.158, the distribution coefficient of sulfur is greatly increased, thereby controlling the proper fluidity of refining slag at a certain alkalinity; and the retention time of the white slag is ≥14.35 min, the refining period is ≥39.47 min, and the soft blowing time is enabled to be >4.58 min, so as to control the outlet [O] content.

RH Vacuum Treating:

The air pressure in a vacuum chamber is pumped below 66.67 kPa for 12.13-14.45 min, and the bottom argon blowing flow rate is 10.35-19.58 $m^3/h$, so as to realize circulation of the molten steel for 4 times; the types and weights of added alloys are strictly controlled, alloys with higher grades, such as low-carbon ferromanganese, metal manganese, low-carbon ferrosilicon and ferrotitanium, are used to ensure that the compositions of the molten steel are completely qualified, and the vacuum is kept for more than 5.37 min after the alloys are added to obtain more pure molten steel; at the same time, a suitable molten steel temperature is provided for continuous casting, which ensures that the superheat of a tundish is 10.28-29.19° C. above the liquidus.

Then the refined molten steel is continuously cast according to the conventional process: the temperature of the continuous casting tundish is 1,542° C., and the pulling speed is 1.23 m/s.

2) Conventional heating treatment and soaking treatment are carried out on the casting slab at the temperature of 1,190° C. for 3.4 hours, and a heat-treated casting slab is obtained.

3) The heat-treated casting slab is continuously rolled, a final rolling temperature is controlled to be 810° C., and the casting slab is cooled by water to 490° C. after rolling, and then naturally cooled to a room temperature to obtain the marine engineering steel.

A specific rolling method in step 3) includes following steps: heating at 1,190° C. for 3.4 hours; continuously rolling the casting slab into a product steel plate, controlling the final rolling temperature to 810° C., and cooling by water to 490° C. after rolling; and naturally cooling to the room temperature for later use.

The microstructure type of the marine engineering steel plate obtained according to the above compositions and preparation process is acicular ferrite and polygonal grain boundary ferrite, and a quantity ratio of the polygonal grain boundary ferrite to the acicular ferrite is 6. The density of corrosion-active inclusions in the marine engineering steel plate is $4/mm^2$. The saturation current density of the marine engineering steel plate at a static electrode potential (E=−300 mV) is 5.5 mA. The corrosion rate of the marine engineering steel plate in a simulated seawater solution (3.5 wt % NaCl solution) is 0.035/mm·a.

Embodiment 2

The present embodiment relates to a seawater corrosion-resistant marine engineering steel, which consists of the following chemical compositions in percentage by mass: 0.068% of C, 0.28% of Si, 1.78% of Cr, 0.049% of Nb, 0.0117% of Zr, 0.0039% of RE, 0.0010% of S, and the balance of Fe and inevitable impurities. The RE includes lanthanum and cerium, and a weight ratio of the lanthanum element to the cerium element is 80:20.

The present embodiment relates to a method for preparing a seawater corrosion-resistant marine engineering steel, which includes the following steps:

1) Molten steel is smelted and refined in turn, then vacuum treatment is carried out, and then the molten steel is continuously cast into a slab to obtain a casting slab.

A method of the smelting and refining in step 1) is as follows: after performing steelmaking on molten iron by using a converter, the temperature and compositions of the molten steel are adjusted, wherein the tapping temperature is adjusted to 1,670° C., and the free oxygen content in the molten steel is 380 ppm; after entering the steel ladle, the molten steel is stirred for 9 min with fine argon bubbling, and then pre-deoxidized by using Fe—Si alloy or Fe—Si—Mn alloy in the steel ladle, so that the free oxygen content in the molten steel is adjusted to 90 ppm; stirring is performed for 6 min with fine argon bubbling, and then the final deoxidization is performed with the composite additive; the composite additive is added into the molten steel in the form of blocky alloy or a cored wire, and a particle size of the composite additive is 18 mm; an addition amount of the composite additive is 3.8 kg per ton of molten steel; and then LF refining and RH refining are performed on the molten steel according to the conventional process.

LF Refining:

The viscosity of refining slag is controlled to 1.535-1.931 Pa·s, so as to improve the inclusion adsorbing ability of a slag system, thereby increasing the cleanliness of the molten steel; the alkalinity R of white slag in a refining furnace is controlled so that $5.22 \leq R \leq 7.48$, which is conductive to increasing the desulfurization rate, increasing the cleanliness of the molten steel and decreasing oxide inclusions in the molten steel; the MI slag index (=a ratio of $CaO/SiO_2$: $Al_2O_3$) is controlled so that MI>0.157, the distribution coefficient of sulfur is greatly increased, thereby controlling the proper fluidity of refining slag at a certain alkalinity; and the retention time of the white slag is ≥14.43 min, the refining period is ≥39.51 min, and the soft blowing time is enabled to be >4.59 min, so as to control the outlet [O] content.

RH Vacuum Treatment:

The air pressure in a vacuum chamber is pumped below 66.57 kPa for 12.11-14.23 min, and the bottom argon blowing flow rate is 10.31-19.59 $m^3/h$, so as to realize circulation of the molten steel for 5 times; the types and weights of added alloys are strictly controlled, alloys with higher-grades, such as low-carbon ferromanganese, metal manganese, low-carbon ferrosilicon and ferrotitanium are used to ensure that the compositions of the molten steel are completely qualified, and the vacuum is kept for more than 5.31 min after the alloys are added to obtain more pure molten steel; at the same time, a suitable molten steel temperature is provided for continuous casting, which ensures that the superheat of a tundish is 10.23-29.29° C. above the liquidus.

Then the refined molten steel is continuously cast according to the conventional process: the temperature of the continuous casting tundish is 1,541° C., and the pulling speed is 1.21 m/s.

2) Conventional heating treatment and soaking treatment are carried out on the casting slab at the temperature of 1,185° C. for 3.45 hours, and a heat-treated casting slab is obtained.

3) The heat-treated casting slab is continuously rolled, a final rolling temperature is controlled to be 840° C., and the casting slab is cooled by water to 540° C. after rolling, and then naturally cooled to a room temperature to obtain the marine engineering steel.

A rolling method in step 3) includes following steps: heating the casting slab at 1,180° C. for 3.5 hours; continuously rolling the casting slab into a product steel plate, controlling the final rolling temperature to 840° C., and cooling by water to 540° C. after rolling; and naturally cooling to the room temperature for later use.

The microstructure type of the marine engineering steel plate obtained according to the above compositions and preparation process is acicular ferrite and polygonal grain boundary ferrite, and a ratio of the polygonal grain boundary ferrite to the acicular ferrite is 5. The density of corrosion-active inclusions in the steel plate is $4.2/mm^2$. The saturation current density of the steel plate at a static electrode potential (E=−300 mV) is 5.8 mA. The corrosion rate of the steel plate in a simulated seawater solution (3.5% NaCl solution) is 0.033/mm·a.

Embodiment 3

The present embodiment relates to a seawater corrosion-resistant marine engineering steel, which consists of the following chemical compositions in percentage by mass: 0.029% of C, 0.15% of Si, 1.55% of Cr, 0.025% of Nb, 0.01% of Zr, 0.0099% of RE, 0.0008% of S, and the balance of Fe and inevitable impurities. The RE includes lanthanum and cerium, and a weight ratio of the lanthanum element to the cerium element is 70:30.

The present embodiment relates to a method for preparing a seawater corrosion-resistant marine engineering steel, which includes the following steps:

1) Molten steel is smelted and refined in turn, then vacuum treatment is carried out, and then the molten steel is continuously cast into a slab to obtain a casting slab.

A method of the smelting and refining in step 1) is as follows: after performing steelmaking on molten iron by using a converter, the temperature and compositions of the molten steel are adjusted, wherein the tapping temperature is adjusted to 1,590° C., and the free oxygen content in the molten steel is 150 ppm; after entering the steel ladle, the molten steel is stirred for 4 min with fine argon bubbling, and then pre-deoxidized by using Fe—Si alloy or Fe—Si—Mn alloy in the steel ladle, so that the free oxygen content in the molten steel is adjusted to 30 ppm; stirring is performed for 4 min with fine argon bubbling, and then the final deoxidization is performed with the composite additive; the composite additive is added into the molten steel in the form of blocky alloy or a cored wire, and a particle size of the composite additive is 6 mm; an addition amount of the composite additive is 0.89 kg per ton of molten steel; and then LF refining and RH refining are performed on the molten steel according to the conventional process.

Lf Refining:

The viscosity of refining slag is controlled to 1.513-1.927 Pa·s, so as to improve the inclusion adsorbing ability of a slag system, thereby increasing the cleanliness of the molten steel; the alkalinity R of white slag in a refining furnace is controlled so that $5.22 \leq R \leq 7.43$, which is conductive to increasing the desulfurization rate, increasing the cleanliness of the molten steel and decreasing oxide inclusions in the molten steel; the MI slag index (=a ratio of $CaO/SiO_2$: $Al_2O_3$) is controlled so that MI>0.153, the distribution coefficient of sulfur is greatly increased, thereby controlling the proper fluidity of refining slag at a certain alkalinity; and the retention time of the white slag is ≥14.37 min, the refining period is ≥39.51 min, and the soft blowing time is enabled to be >4.63 min, so as to control the outlet [O] content, RH vacuum treatment:

The air pressure in a vacuum chamber is pumped below 66.67 kPa for 12.24-14.36 min, and the bottom argon blowing flow rate is 10.17-19.43 $m^3/h$, so as to realize circulation of the molten steel for 6 times; the types and weights of added alloys are strictly controlled, alloys with higher-grades, such as low-carbon ferromanganese, metal manganese, low-carbon ferrosilicon and ferrotitanium, are used to ensure that the compositions of the molten steel are completely qualified, and the vacuum is kept for more than 5.31 min after the alloys are added to obtain more pure molten steel; at the same time, a suitable molten steel temperature is provided for continuous casting, which ensures that the superheat of a tundish is 10.31-29.25° C. above the liquidus.

Then the refined molten steel is continuously cast according to the conventional process: the temperature of the continuous casting tundish is 1,540° C., and the pulling speed is 1.25 m/s.

2) Conventional heating treatment and soaking treatment are carried out on the casting slab at the temperature of 1,187° C. for 3.5 hours, and a heat-treated casting slab is obtained.

3) The heat-treated casting slab is continuously rolled, a final rolling temperature is controlled to be 770° C., and the casting slab is cooled by water to 430° C. after rolling, and then naturally cooled to a room temperature to obtain the marine engineering steel.

A rolling method in step 3) includes following steps: heating the casting slab at 1,210° C. for 3.1 hours; continuously rolling the casting slab into a product steel plate, controlling the final rolling temperature to 770° C., and cooling by water to 430° C. after rolling; and naturally cooling to the room temperature for later use.

The microstructure type of the marine engineering steel plate obtained according to the above compositions and preparation process is acicular ferrite and polygonal grain boundary ferrite, and a ratio of the polygonal grain boundary ferrite to the acicular ferrite is 4. The density of corrosion-active inclusions in the steel plate is 4.7/mm$^2$. The saturation current density of the steel plate at a static electrode potential (E=−300 mV) is 5.5 mA. The corrosion rate of the steel plate in a simulated seawater solution (3.5% NaCl solution) is ≤0.038/mm·a.

Test Case

The corrosion resistance of the marine engineering steel with excellent seawater corrosion resistance prepared in Embodiment 1 is analyzed and tested.

1. Test Method (1) Electrochemical Corrosion Experiment

The environment of an electrochemical corrosion experiment is at a room temperature, and the corrosive solution is a 3.5% NaCl solution, which simulates a corrosion environment. The electrode is implemented by a classic tri-electrode system: a sample is a working electrode, a platinum electrode is an auxiliary electrode, and a saturated calomel electrode (SCE) is a reference electrode. An electrochemical device is a ZAHNER electrochemical workstation. Parameters are set by the Thales electrochemical software, and the workstation is connected to a computer for data display.

The electrochemical corrosion experiment is carried out at the room temperature, and a potentiodynamic polarization curve (Tafel) and an electrochemical impedance (EIS) of a small sheet sample are tested. Before the test, the sample is soaked in the corrosive solution for 40 min, and then electrochemical impedance and potentiodynamic polarization tests are carried out after an open circuit potential (OCP) is stable. The transition signal of sine waves applied by the electrochemical impedance is 10 mV, and a test scanning range is 10 mHz to 10 KHz. A scanning rate of the potentiodynamic polarization curve is 0.5 mV/s and a scanning range is-600 mV to 1.2V. The potentiodynamic polarization curve and an electrochemical impedance curve are fitted by the Origin and Zsimpwin softwares respectively.

An AC impedance method disturbs the electrode system with small-amplitude sine waves of different frequencies, an equivalent circuit of the electrodes is inferred through the relationship between a response of the electrode system and a disturbance signal, and the parameters of various elements in the equivalent circuit are fitted, so as to obtain corrosion kinetic parameters of the material, and directly and quantitatively analyze factors affecting the corrosion resistance of the material and further understand corrosion behaviors of the material.

The corrosion electrochemical experiment is carried out in the classical tri-electrode system, the electrochemical sample to be tested serves as the working electrode, the saturated calomel electrode (SCE) serves as the reference electrode, a platinum sheet serves as a counter electrode, and the test temperature is normal temperature 25° C. At the room temperature, for a weld metal in an as-welded state, the OCP is tested by soaking the sample in the corrosive solution, the test time is 40 min, and then the electrochemical impedance test is started after the OCP is stable. The amplitude of the sine waves applied by the electrochemical AC impedance is 10 mV, the scanning frequency range is 10 mHz to 10 kHz, and the scanning time is 40 min.

(2) Determination of the Density of the Corrosion-Active Inclusions

A sample is cut into a size of 10×10×10 mm, the surface is mechanically ground to 1500 meshes and then polished to a mirror surface, a corrosive reagent is prepared according to the following proportion: every 100 mL of ethanol solution contains 4.5-5.5 mL of concentrated hydrochloric acid, 0.08-0.15 g of $CuCl_2$, 0.03-0.08 g of $SnCl_2$ and 2.6-3.4 g of $FeCl_3$, the corrosive reagent is dropped on the surface of the sample for treatment for 5-10 s, then the surface is rinsed with alcohol and blow-dried, and the density of the corrosion-active inclusions is counted by placing the sample under a metallographic microscope at a magnification of 100×.

2. Test Results and Analysis

FIG. 1 shows a potentiodynamic polarization result of the marine engineering steel prepared in Embodiment 1 in the 3.5% NaCl solution. As can be seen from FIG. 1, the marine engineering steel prepared in Embodiment 1 has a corrosion potential of −0.535V and a corrosion current density of $2.012\times10^{-5}$ A·cm$^{-2}$.

Figure 2:
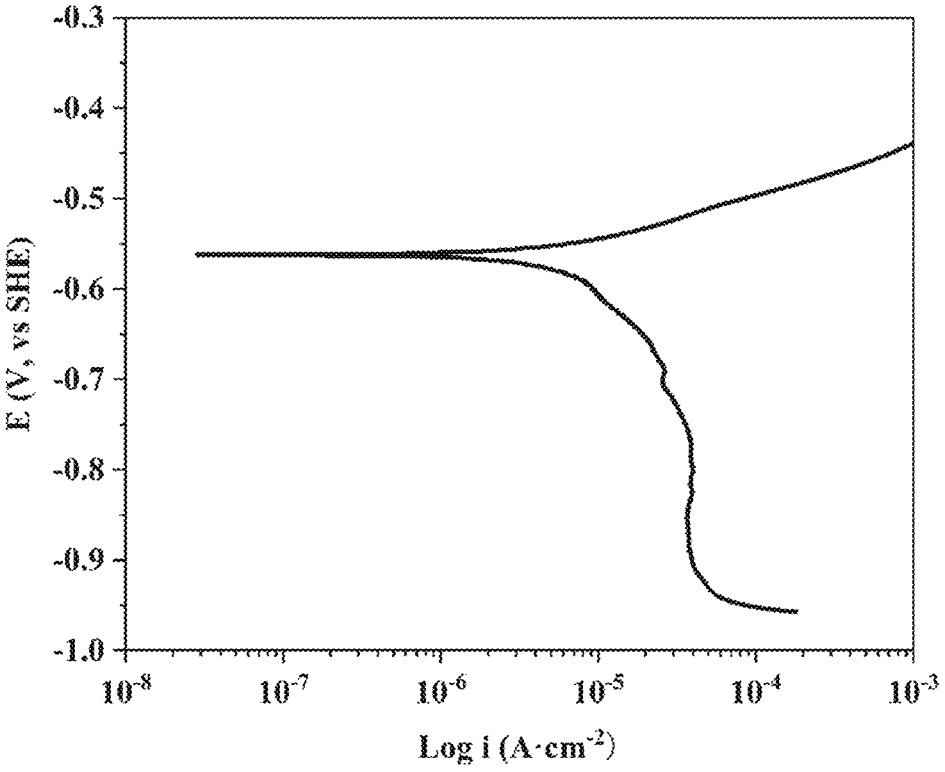
FIG. 2 shows a potentiodynamic polarization result of a comparative steel in a 3.5% NaCl solution according to the present invention.
Figure 3A:
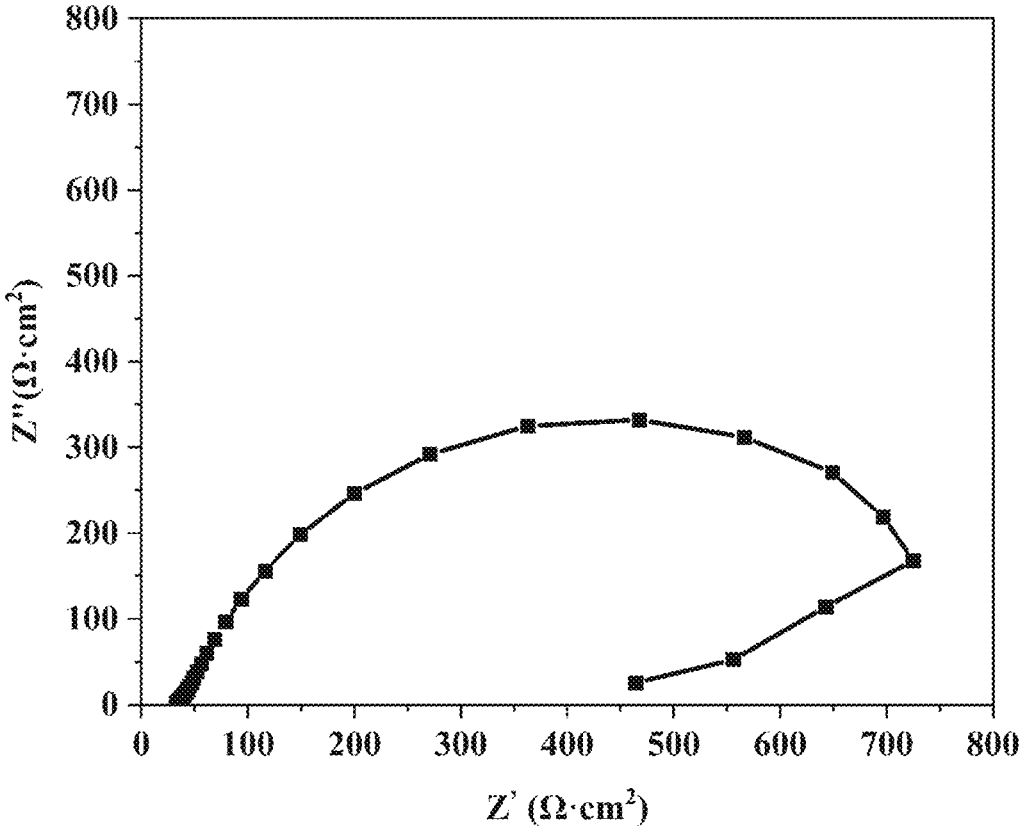
Figure 3B:
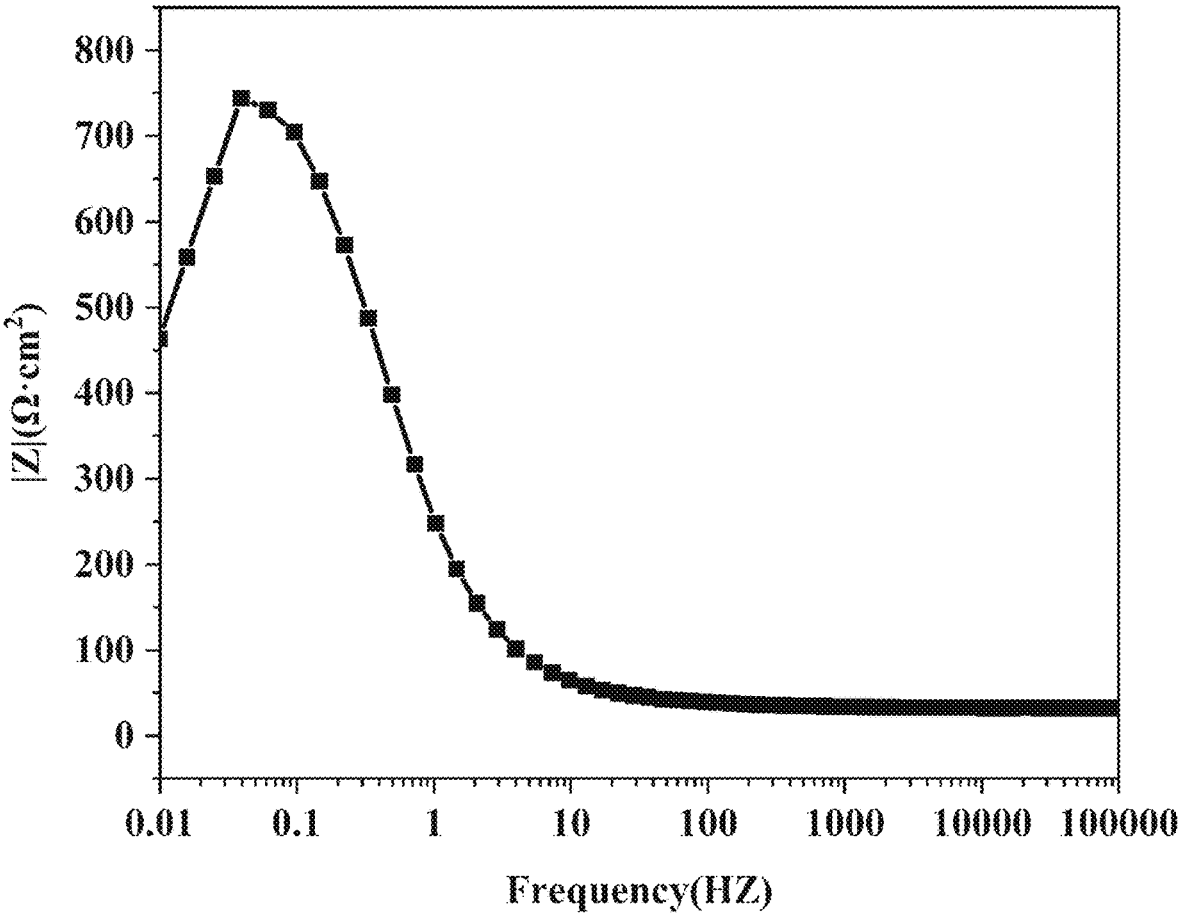
Figure 3C:
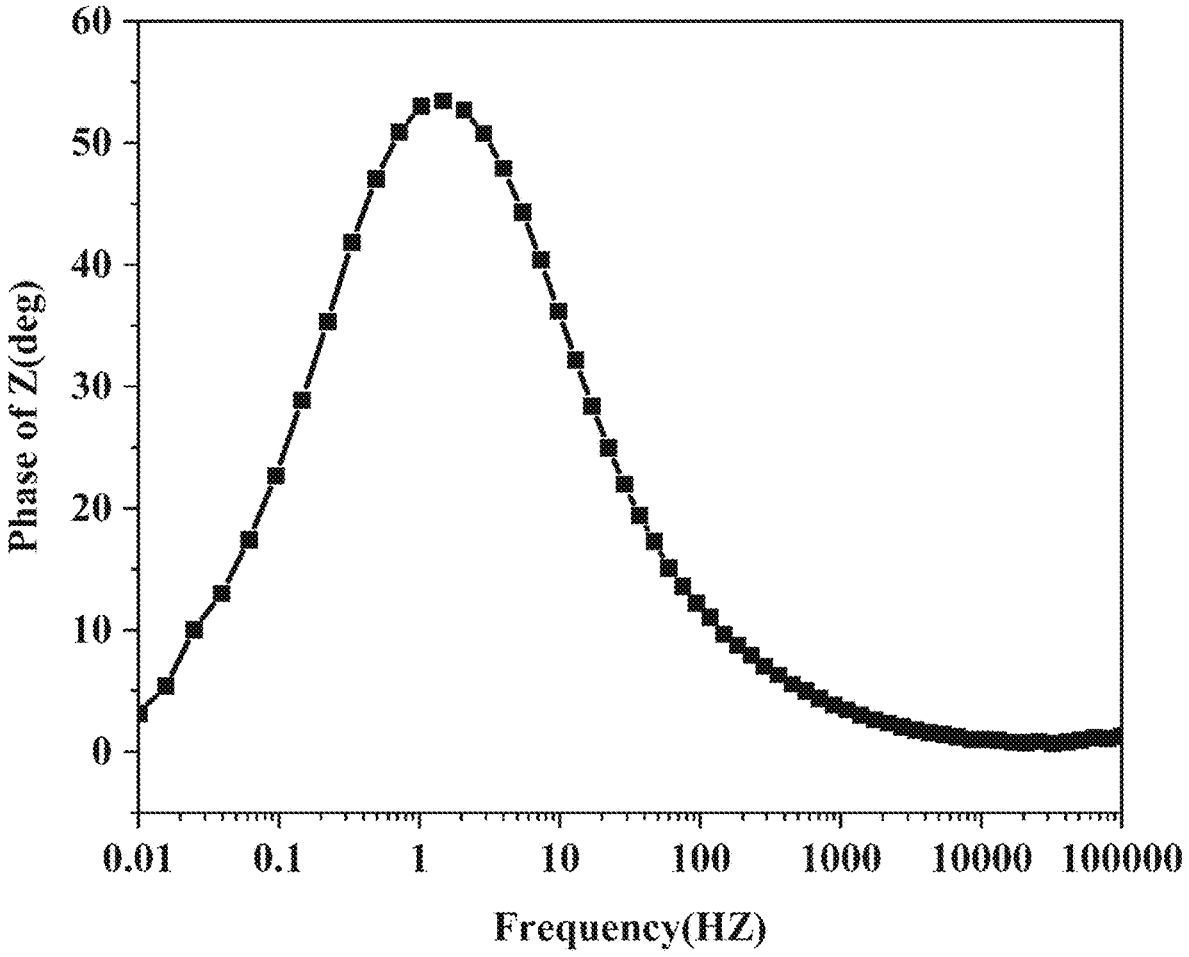
Figure 3D:
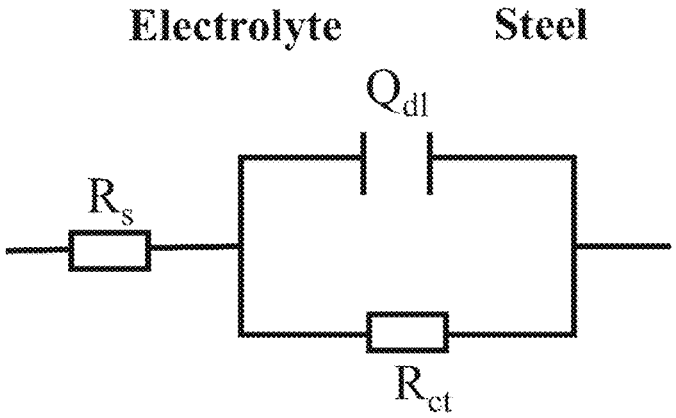
Figure 4A:
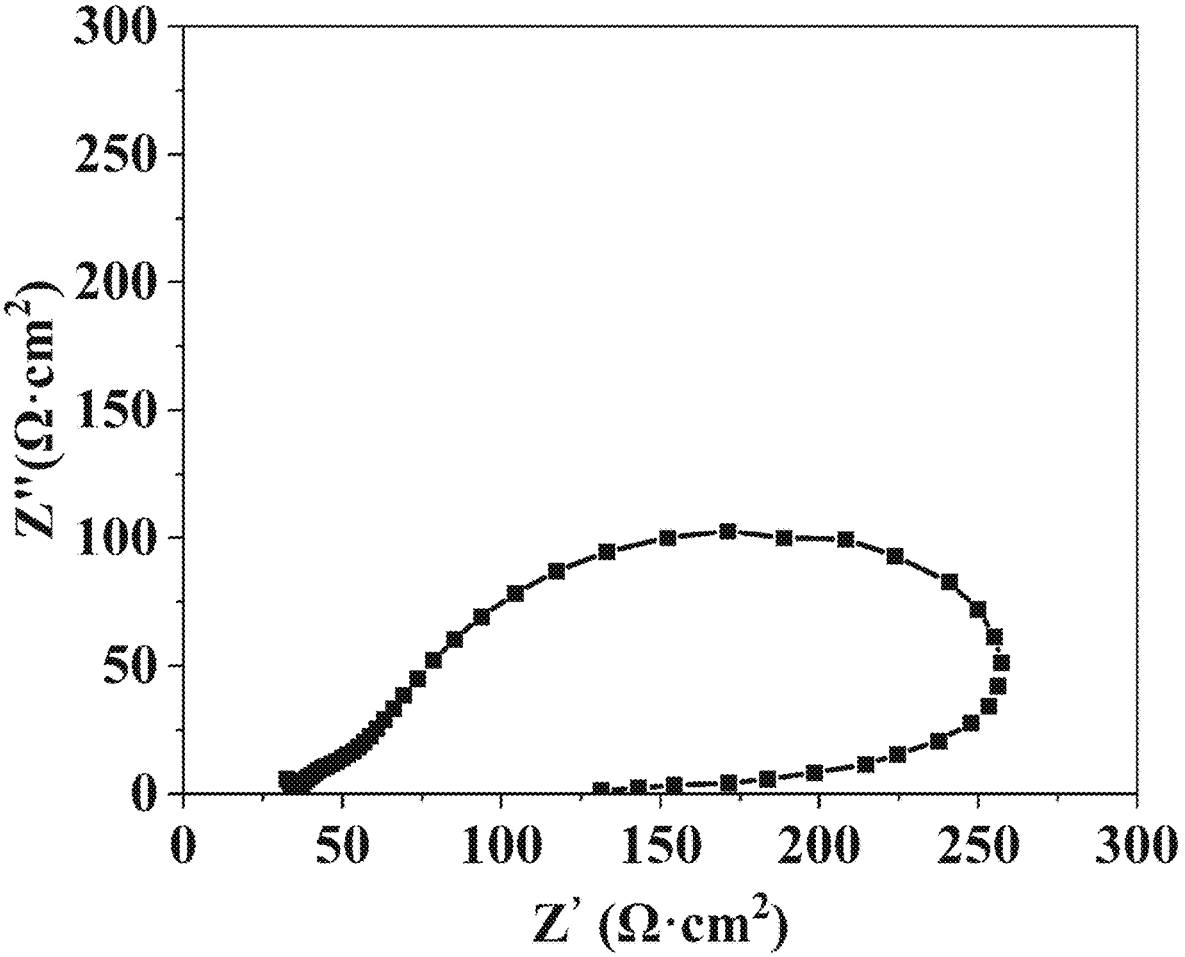
Figure 4B:
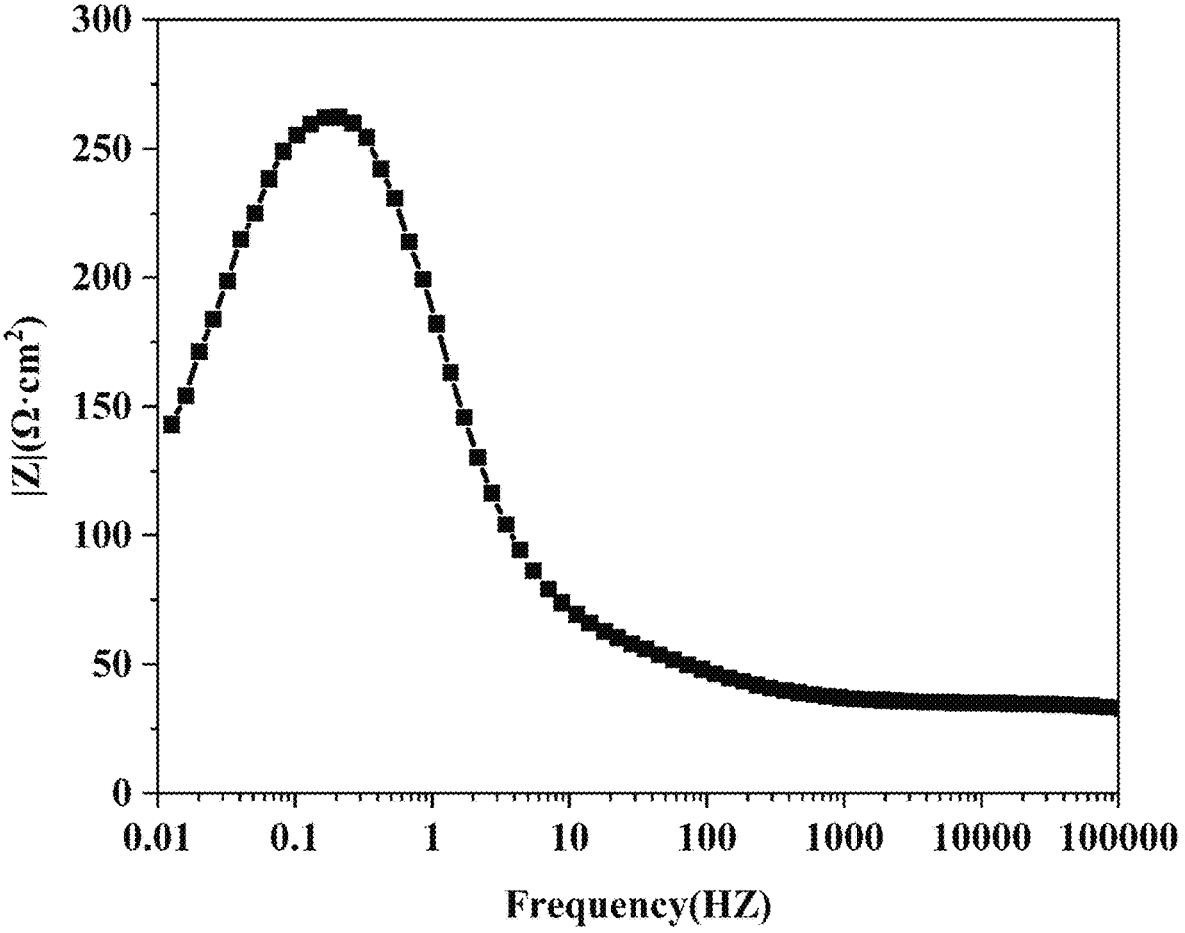
Figure 4C:
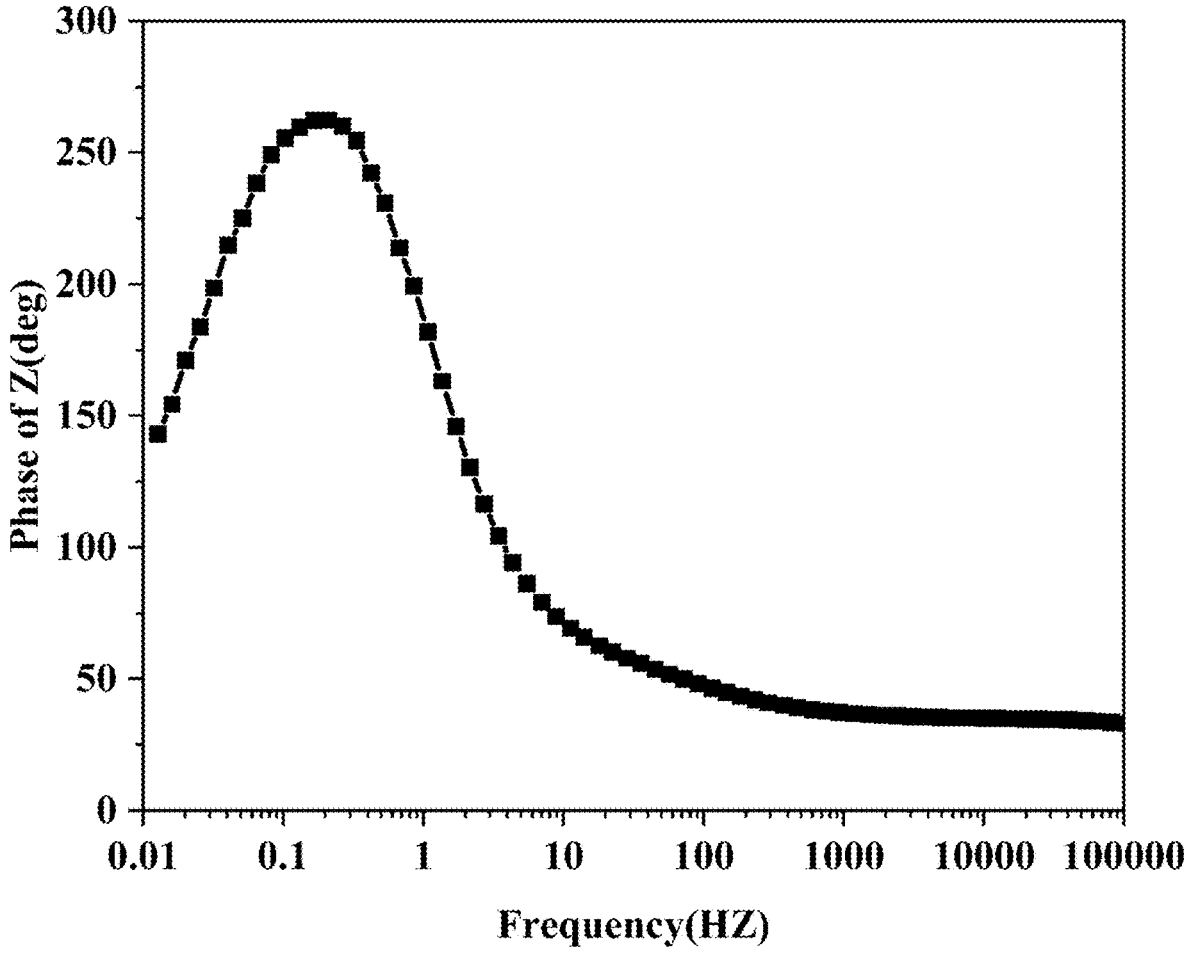
Figure 4D:
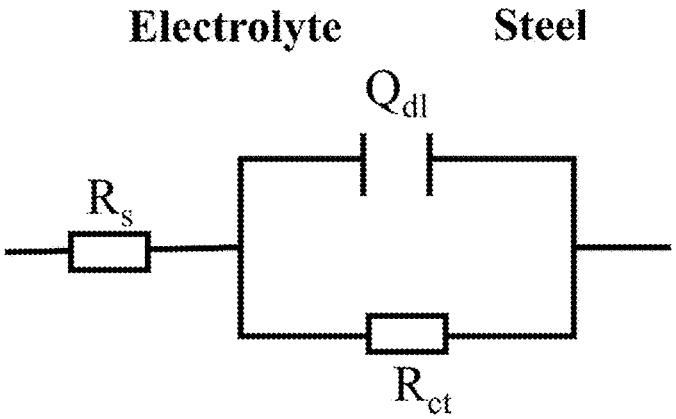

FIG. 2 shows a potentiodynamic polarization result of a comparative steel in the 3.5% NaCl solution. As can be seen from FIG. 2, the comparative steel has a corrosion potential of −0.5619V and a corrosion current density of $8.509\times10^{-5}$ A·cm$^{-2}$.

FIGS. 3A-3D show an AC impedance test result of the marine engineering steel prepared in Embodiment 1 in the 3.5% NaCl solution. Table 1 shows an AC impedance fitting result. The constant phase angle index n in Table 1 reflects the deviation between an actual capacitance and an ideal capacitance. The greater the value of n, the smaller the deviation between the actual capacitance and the ideal capacitance. Generally, the value of n of an electric double-layer capacitance of a corroding electrode is between 0.5 and 1. As can be seen from the results in FIGS. 3A-3D and Table 1, a charge transfer resistance of the marine engineering steel prepared in Embodiment 1 is 808.6 Ω·cm$^{-2}$.

TABLE 1

AC impedance fitting result of marine engineering steel prepared in Embodiment 1 in 3.5% NaCl solution

| | $R_s$, (Ω · cm$^{-2}$) | $Y_0$, (S · sec$^n$ · cm$^{-2}$) | Constant phase angle index n | $R_{ct}$, (Ω · cm$^{-2}$) |
|---|---|---|---|---|
| Marine engineering steel | 33.69 | 0.0009014 | 0.7782 | 808.6 |

FIG. 4A-4D show the AC impedance test result of the marine engineering steel prepared in Embodiment 1 in the 3.5% NaCl solution. Table 2 shows the AC impedance fitting result. As can be seen from the results in FIGS. 4A-4D and Table 2, the charge transfer resistance of the comparative steel is 233.7 $\Omega \cdot cm^{-2}$.

TABLE 2

AC impedance fitting result of comparative steel in 3.5% NaCl solution

| | $R_s$, ($\Omega \cdot cm^{-2}$) | $Y_0$, ($S \cdot sec^n \cdot cm^{-2}$) | Constant phase angle index n | $R_{ct}$, ($\Omega \cdot cm^{-2}$) |
|---|---|---|---|---|
| Q345 | 36.24 | 0.001118 | 0.683 | 233.7 |

Figure 5:
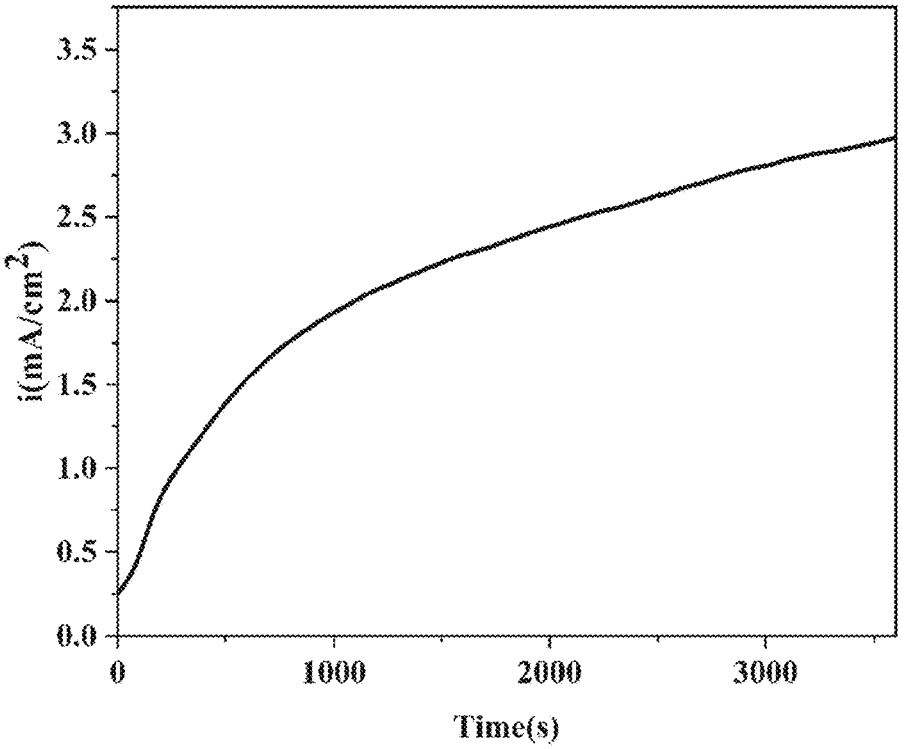
FIG. 5 shows a potentiostatic polarization result of a marine engineering steel prepared in Embodiment 1 in a chloride ion medium according to the present invention.

FIG. 5 shows that the saturation current density of the marine engineering steel prepared in Embodiment 1 acquired by a potentiostatic polarization test is 3.25 $mA/cm^2$. It is generally considered that if the saturation current density is ≥6 $mA/cm^2$ and ≤8 $mA/cm^2$, the corrosion resistance to a chloride ion aqueous medium is considered to be better. If the saturation current density is ≤6 $mA/cm^2$, the corrosion resistance to the chloride ion aqueous medium is considered to be excellent. The above results show that the marine engineering steel according to the present invention has excellent corrosion resistance to the chloride ion aqueous medium.

Figure 6:
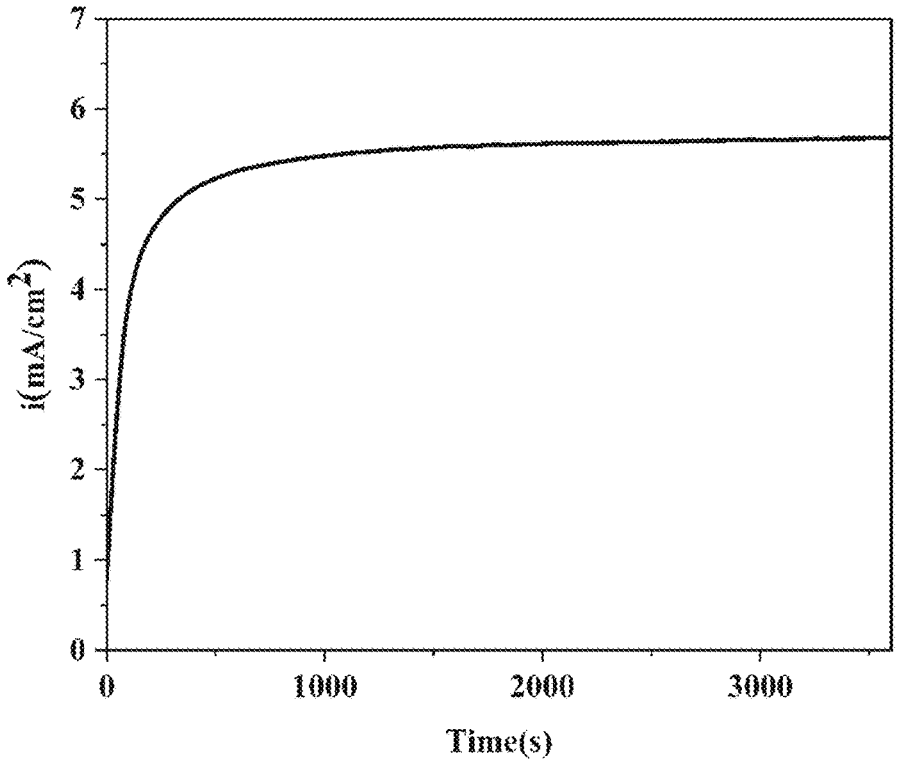
FIG. 6 shows a potentiostatic polarization result of a comparative steel in a chloride ion medium according to the present invention.

FIG. 6 shows that the saturation current density of the comparative steel obtained by the potentiostatic polarization test is 5.71 $mA/cm^2$. The above result show that the comparative steel has good corrosion resistance to the chloride ion aqueous medium.

Figure 7:
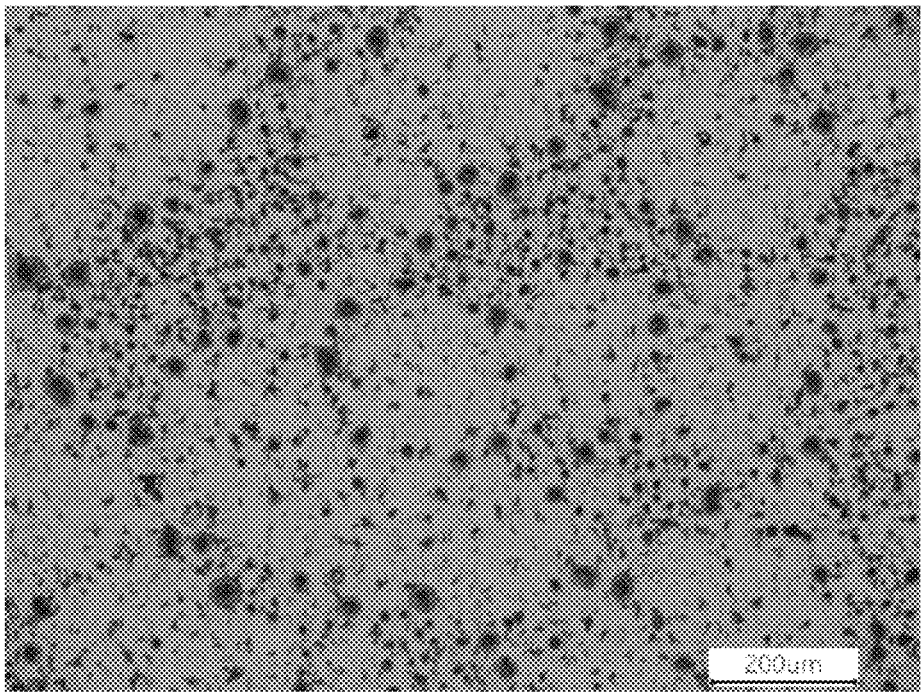
FIG. 7 is a micrograph of corrosion-active inclusions in a comparative steel according to the present invention.

FIG. 7 is a micrograph of corrosion-active inclusions in the comparative steel. The measurement result shows that the density of the corrosion-active inclusions in the comparative steel is $15/mm^2$.

Figure 8:
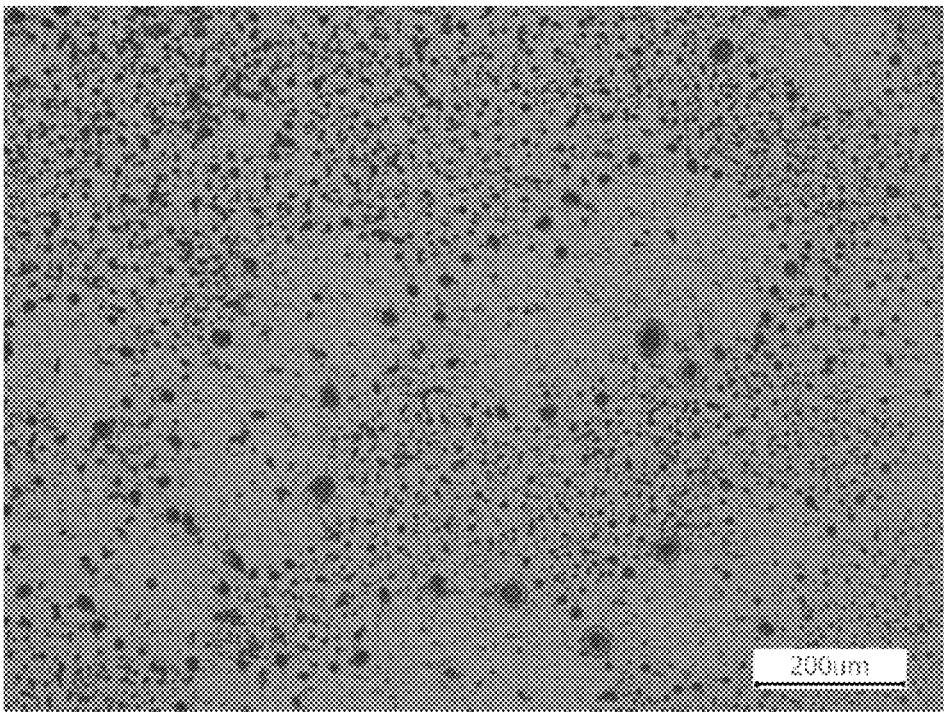
FIG. 8 is a micrograph of corrosion-active inclusions in a marine engineering steel prepared in Embodiment 1 according to the present invention.

FIG. 8 is a micrograph of the corrosion-active inclusions in the marine engineering steel prepared in Embodiment 1. The measurement result show that the density of the corrosion-active inclusions in the marine engineering steel prepared in Embodiment 1 is $4/mm^2$. The density of the corrosion-active inclusions in the marine engineering steel prepared in Embodiment 1 is less than 50% of that in the comparative steel.

As can be seen from the above test results, the order of the corrosion current density is: comparative steel>marine engineering steel prepared in Embodiment 1, the order of the charge transfer resistance is: comparative steel<marine engineering steel prepared in Embodiment 1, and the order of the saturation current density is: comparative steel>marine engineering steel prepared in Embodiment 1, which indicate that the corrosion resistance to the chloride ion aqueous medium of the marine engineering steel prepared in Embodiment 1 is excellent and obviously superior to that of the comparative steel.

In summary, the marine engineering steel according to the present invention is designed with cheap chemical compositions of low carbon, low silicon and medium chromium, and is completely free of precious corrosion-resistant metal elements such as Ni and Cu, thereby greatly reducing the material cost; instead of the traditional Al deoxidization technology, Si deoxidization assisted by Zr-RE composite deoxidization is used to form a fine, dispersed and uniform composite oxysulfide, which greatly decreases the density of the corrosion-active inclusions and significantly improves the seawater corrosion resistance. Such a steel is especially suitable for a marine environment steel such as a marine engineering steel, a warship and ship steel, an offshore fixed wind power steel, an offshore floating wind power steel, a coastal cross-sea bridge steel, an iron tower steel and a track steel, and can obviously improve the corrosion resistance to the seawater mediums rich in chloride ions.

In descriptions of the description, the descriptions referring to the terms "one embodiment". "some embodiments", "examples", "specific examples" or "some examples" mean that specific features, structures, materials or characteristics described in conjunction with the embodiments or examples are included in at least one embodiment or example according to the present invention. In the description, the schematic expressions of the above terms are not necessarily aimed at the same embodiment or example. Moreover, the specific features, structures, materials or characteristics described may be combined in any one or more embodiments or examples in an appropriate way. In addition, different embodiments or examples and features of different embodiments or examples described in the description without contradicting each other can be combined by those skilled in the art.

Although the embodiments according to the present invention have been shown and described above, it can be understood that the above embodiments are exemplary and cannot be understood as limitations to the present invention, and those skilled in the art can make variations, modifications, substitutions and transformations to the above embodiments within the scope of the present invention.

What is claimed is:

1. A seawater corrosion-resistant marine engineering steel, comprising the following chemical compositions in percentage by mass: C: 0.011-0.069%, Si: 0.11-0.29%, Cr: 1.51-1.99%, Nb: 0.02-0.05%, Zr: 0.01-0.02%, RE: 0.0034-0.02%, and a balance of Fe and inevitable impurities; wherein mass percentages of Zr element and RE element further satisfy the following formulas: 0.01%<Zr+RE<0.02% and Zr/RE=1-3, wherein a microstructure type of the seawater corrosion-resistant marine engineering steel is acicular ferrite and polygonal grain boundary ferrite, and a quantity ratio of the polygonal grain boundary ferrite to the acicular ferrite is 4-8.

2. The seawater corrosion-resistant marine engineering steel according to claim 1, wherein the seawater corrosion-resistant marine engineering steel comprises the following chemical compositions in percentage by mass: C: 0.029-0.068%, Si: 0.15-0.28%, Cr: 1.55-1.78%, Nb: 0.025-0.049%, Zr: 0.01-0.0117%, RE: 0.0039-0.0099%, and the balance of Fe and inevitable impurities.

3. The seawater corrosion-resistant marine engineering steel according to claim 1, wherein the seawater corrosion-resistant marine engineering steel comprises the following chemical compositions in percentage by mass: C: 0.04%, Si: 0.20%, Cr: 1.75%, Nb: 0.035%, Zr: 0.012%, RE: 0.006%, and the balance of Fe and inevitable impurities.

4. The seawater corrosion-resistant marine engineering steel according to claim 1, wherein in the inevitable impurities, a mass percentage of S element satisfies: S≤0.0010%.

5. The seawater corrosion-resistant marine engineering steel according to claim 1, wherein the RE element comprises lanthanum and cerium, and a weight ratio of the lanthanum element to the cerium element is (70-90):(10-30).

6. The seawater corrosion-resistant marine engineering steel according to claim 1, wherein a density of corrosion-active inclusions in the seawater corrosion-resistant marine engineering steel is less than or equal to $5/mm^2$.

7. A seawater corrosion-resistant marine engineering steel, comprising the following chemical compositions in percentage by mass: C: 0.011-0.069%, Si: 0.11-0.29%, Cr: 1.51-1.99%, Nb: 0.02-0.05%, Zr: 0.01-0.02%, RE: 0.0034-0.02%, and a balance of Fe and inevitable impurities; wherein mass percentages of Zr element and RE element further satisfy the following formulas: 0.01%<Zr+RE<0.02% and Zr/RE=1-3, wherein a saturation current density of the seawater corrosion-resistant marine engineering steel is less than or equal to 6.0 mA under a condition that a static electrode potential is equal to −300 mV; and a corrosion rate of the seawater corrosion-resistant marine engineering steel is less than or equal to 0.04/mm a under a condition that a mass content of NaCl in a seawater solution is 3.5%.

8. A method for preparing a seawater corrosion-resistant marine engineering steel, the seawater corrosion-resistant marine engineering steel comprising the following chemical compositions in percentage by mass: C: 0.011-0.069%, Si: 0.11-0.29%, Cr: 1.51-1.99%, Nb: 0.02-0.05%, Zr: 0.01-0.02%, RE: 0.0034-0.02%, and a balance of Fe and inevitable impurities; wherein mass percentages of Zr element and RE element further satisfy the following formulas: 0.01%<Zr+RE<0.02% and Zr/RE=1-3, the method comprising following steps:

1) smelting and refining molten steel in turn, carrying out vacuum treatment, and continuously casting the molten steel into a slab to obtain a casting slab;
2) Heating and soaking the casting slab to obtain a heat-treated casting slab; and
3) Continuously rolling the heat-treated casting slab, controlling a final rolling temperature to 750-850° C., cooling by water to 410-550° C. after rolling, and naturally cooling to a room temperature to obtain the seawater corrosion-resistant marine engineering steel.

9. The method for preparing the seawater corrosion-resistant marine engineering steel according to claim 8, wherein a method for the smelting and refining in step 1) comprises following steps: steelmaking molten iron and/or scrap steel by using a converter or an electric arc furnace, and adjusting a temperature and compositions to obtain the molten steel; bringing the molten steel into a steel ladle and stirring the molten steel with fine argon bubbling, and pre-deoxidizing the molten steel in the steel ladle by using Fe—Si alloy or Fe—Si—Mn alloy to adjust a free oxygen content in the molten steel to 19-99 ppm; and stirring the molten steel with fine argon bubbling and carrying out final deoxidization by a composite additive, and carrying out ladle furnace (LF) refining, vacuum degassing (VD) refining or Ruhrstahl-Heraeus (RH) refining on the molten steel after the final deoxidization.

10. The seawater corrosion-resistant marine engineering steel according to claim 2, wherein in the inevitable impurities, a mass percentage of S element satisfies: S≤0.0010%.

11. The seawater corrosion-resistant marine engineering steel according to claim 3, wherein in the inevitable impurities, a mass percentage of S element satisfies: S≤0.0010%.

12. The seawater corrosion-resistant marine engineering steel according to claim 2, wherein the RE element comprises lanthanum and cerium, and a weight ratio of the lanthanum element to the cerium element is (70-90):(10-30).

13. The seawater corrosion-resistant marine engineering steel according to claim 3, wherein the RE element comprises lanthanum and cerium, and a weight ratio of the lanthanum element to the cerium element is (70-90):(10-30).

14. The seawater corrosion-resistant marine engineering steel according to claim 2, wherein a density of corrosion-active inclusions in the seawater corrosion-resistant marine engineering steel is less than or equal to 5/mm$^2$.

15. The seawater corrosion-resistant marine engineering steel according to claim 3, wherein a density of corrosion-active inclusions in the seawater corrosion-resistant marine engineering steel is less than or equal to 5/mm$^2$.

16. The seawater corrosion-resistant marine engineering steel according to claim 2, wherein a saturation current density of the seawater corrosion-resistant marine engineering steel is less than or equal to 6.0 mA under a condition that a static electrode potential is equal to −300 mV; and a corrosion rate of the seawater corrosion-resistant marine engineering steel is less than or equal to 0.04/mm a under a condition that a mass content of NaCl in a seawater solution is 3.5%.

17. The seawater corrosion-resistant marine engineering steel according to claim 3, wherein a saturation current density of the seawater corrosion-resistant marine engineering steel is less than or equal to 6.0 mA under a condition that a static electrode potential is equal to −300 mV; and a corrosion rate of the seawater corrosion-resistant marine engineering steel is less than or equal to 0.04/mm·a under a condition that a mass content of NaCl in a seawater solution is 3.5%.

* * * * *